United States Patent [19]

O'Brien

[11] Patent Number: 4,671,417

[45] Date of Patent: Jun. 9, 1987

[54] PRE-PACK PRODUCT DISPLAY SYSTEM WITH SUPPORT FIXTURE

[75] Inventor: Paul O'Brien, Seal Beach, Calif.

[73] Assignee: O.B.I. Co., Seal Beach, Calif.

[21] Appl. No.: 811,175

[22] Filed: Dec. 20, 1985

[51] Int. Cl.[4] ..... A47F 7/00

[52] U.S. Cl. ..... 211/59.1; 248/220.3; 248/231.8

[58] Field of Search ..... 248/220.3, 220.2, 221.3, 248/231.8; 211/57.1, 59.1

[56] References Cited

U.S. PATENT DOCUMENTS

| | | | |
|---|---|---|---|
| 3,094,892 | 6/1963 | Topf | 248/220.3 |
| 3,198,342 | 8/1965 | Murray | 248/220.3 X |
| 3,229,944 | 1/1966 | Everburg | 248/220.3 |
| 3,252,678 | 5/1966 | Meyers et al. | 248/220.3 |
| 3,273,844 | 9/1966 | Hodson et al. | 248/216.1 |
| 3,312,442 | 4/1967 | Moeller | 248/216.1 |
| 3,469,710 | 9/1969 | Yosbikian | 248/222.2 |
| 3,516,634 | 6/1970 | Salaua et al. | 248/220.3 |
| 4,441,619 | 4/1984 | Gibitz | 211/59.1 X |
| 4,485,929 | 12/1984 | Betts | 211/59.1 X |

FOREIGN PATENT DOCUMENTS

| | | | |
|---|---|---|---|
| 103361 | 12/1962 | Netherlands | 248/220.3 |

*Primary Examiner*—Robert W. Gibson, Jr.

*Attorney, Agent, or Firm*—Poms, Smith, Lande & Rose

[57] ABSTRACT

A retail product display system which may be prepacked with product before shipment has a support fixture and a support stand made up of at least one sheet of thin, planar material foldable along a plurality of lines and assemblable into a rigid, three-dimensional, free-standing, upright, folded-plane structure containing a plurality of horizontal, rectangular apertures for mounting the support fixture therein. The support fixtures have one end cantilevered outwardly from the stand at a slight inclination to the horizontal for suspending the product therefrom, and a mounting end adapted to permit insertion into the mounting apertures from one side only of the display stand with means located thereat for gripping the support stand material through the mounting aperture and for coupling loads applied to the fixture from any direction to the support stand such that the fixture is resistant to withdrawal from the mounting aperture regardless of the attitude of the support stand.

13 Claims, 8 Drawing Figures

Fig. 1.
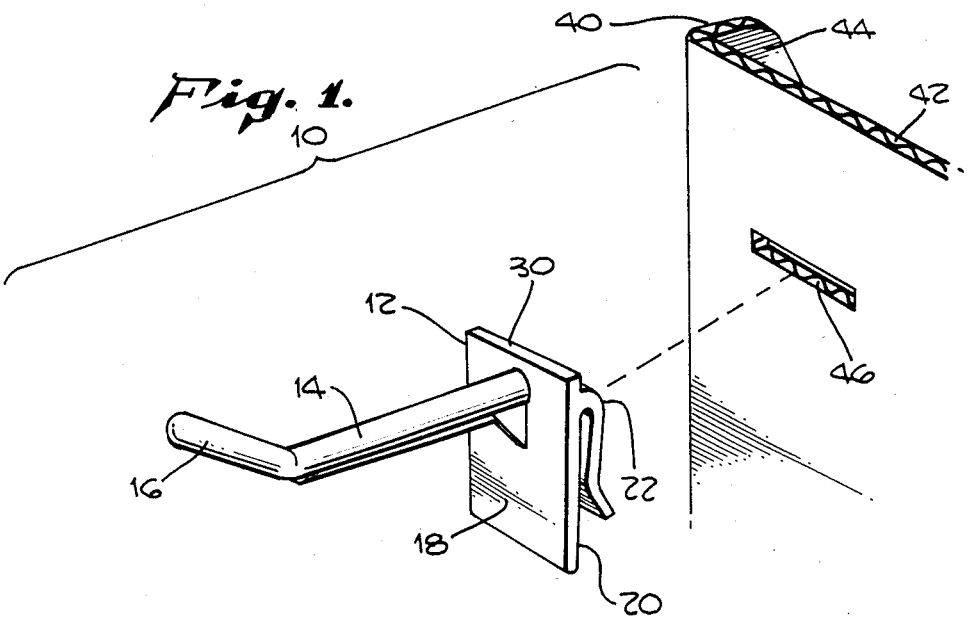
Fig. 2.
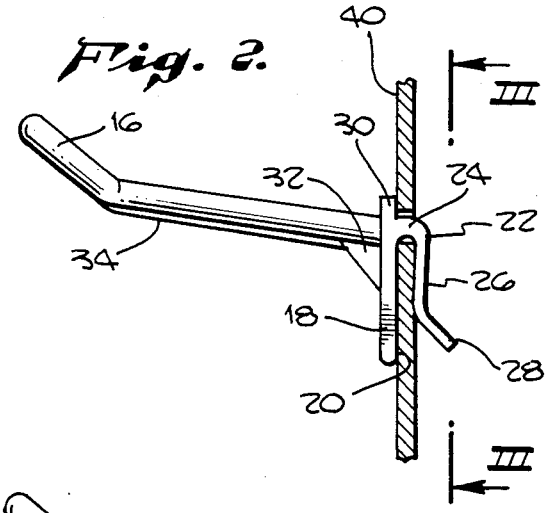
Fig. 3.
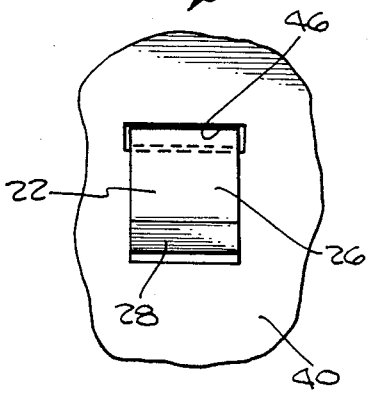
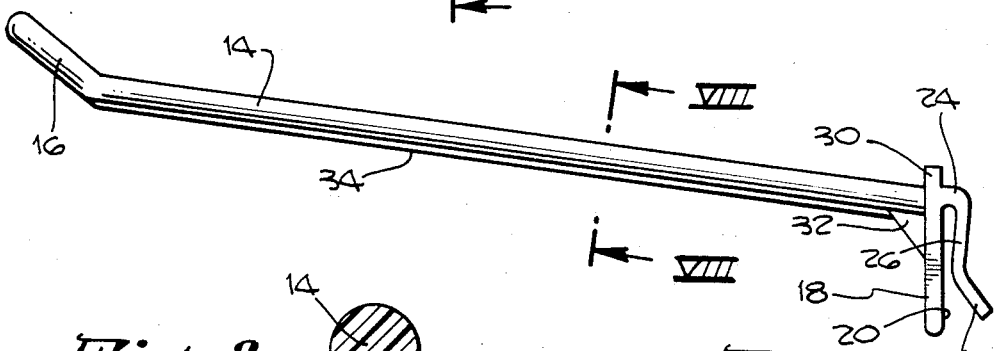
Fig. 7.
Fig. 8.
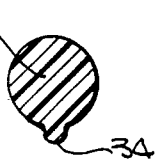

10
12
40
41
50
51
52
54
16
V

PRE-PACK PRODUCT DISPLAY SYSTEM WITH SUPPORT FIXTURE7

FIELD OF THE INVENTION

This invention pertains, in general, to point-of-purchase display systems, and in particular, to a foldup display rack and product support fixture which can be pre-packed with the product before packaging for shipment to the point-of-purchase merchant for final assembly.

DESCRIPTION OF RELATED ART

The retail sales industry has, in recent years, experienced a strong growth in point-of-purchase display systems, such as display racks, containers, etc. This growth is due primarily to marketing studies which have shown that point-of-purchase display systems can result in increased sales ratios of nearly four-to-one over conventional retailers' shelf displays.

Typically, in point-of-purchase display systems, the manufacturer and/or distributor of a particular line of products will provide the retailer not only with an attractively packaged product, but also a functional stand or rack which is designed to hold or contain the product in an orderly fashion, and also to display the product in a pleasing, attention-getting manner. Also typically, these display systems are manufactured expressly for the particular manufacturer at his instance, contain artwork and product information printed colorfully thereon expressly directed to the particular product to be displayed, and are supplied in a disassembled, or partially-assembled configuration (along with assembly instructions) for inclusion in the manufacturer's shipping container to the point-of-purchase retailer.

In such a display system, a display stand or rack is constructed of a lightweight, inexpensive material, e.g., cardboard, which may be folded up into a rigid, folded-plane structure containing attractive artwork and/or consumer information related to the product. In some configurations, open-top, round or rectangular bins may be formed into one side of the stand to retain and display the product conveniently and to provide ease of selection to the purchaser. In other configurations, the display stand is provided with a plurality of support fixtures projecting outwardly from the stand which are inserted into suitable apertures contained in the product or the product's package such that the product is suspended from the fixture in an orderly, tandem fashion.

Manufacturers have learned that retailers demonstrate a strong preference for so-called "pre-packed" displays, i.e., those in which the product has already been stocked or installed onto the rack in a partially-assembled configuration such that, upon receipt of the manufacturer's shipping container, the merchant or retailer has only to assemble the stand components to achieve a fully-stocked display system which is ready for presentation to the customer. This is because the "set-up ratio," i.e., the profit per individual product sold is very high when contrasted with the hand-stocking procedures employed with conventional display shelves or merchant-stocked display racks.

One of the problems with those point-of-purchase display systems presenting products suspended from outwardly-projecting support fixtures is that the hooks are designed to provide support only when the hooks are being loaded in a downward direction relative to an fully-assembled, upright display rack. Thus, when the manufacturer attempts to pre-pack a partially-assembled rack, e.g., when the partially-assembled rack is lying prone on a packing table for packaging before shipment, any force exerted upon the support fixture in a direction other than in the vertically-downward direction relative to an upright stand will result in the fixture becoming dislodged from the stand with resultant spilling of the product. A similar result can occur at the point-of-purchase end when the merchant attempts to remove the pre-packed system from its shipping container.

An example of the kinds of support fixtures which have been utilized heretofore is to be found in U.S. Pat. No. 3,273,844 to Hodson, et al. Hodson's display hook is adapted to fit in a horizontal wall slot and contains a three-dimensional triangular projection from a lower plate having a pointed, triangular end for piercing the wall to lock the hook thereto.

Salava, et al., in U.S. Pat. No. 3,516,634, teach a two-part fixture assembly for a perforated panel in which the two parts slide together during assembly of the fixture to the panel to lock the fixture against upward-acting forces.

In U.S. Pat. No. 3,252,678 to Myers, et al., a display support is disclosed which may be utilized with a thin, panel-like material containing vertical, rectangular slots, but provides little resistance to lateral or upward forces acting upon the support.

U.S. Pat. No. 3,229,944 to Everberg discloses a relatively more-complicated display fixture for eyeglasses and the like adapted to be mounted to relatively thin display panels and requires a retaining clip installed from the back side of the panel.

None of these prior art devices teaches a one-piece product support fixture which is well adapted to be installed by access to only one side of a perforated panel, such as a free-standing cardboard display rack, and which, when installed, provides adequate resistance to forces likely to be encountered during pre-packing, packaging for shipment, shipment and assembly of the pre-packed display system.

Thus, it would be desirable to provide an inexpensive, reliable product display system utilizing outwardly-projecting product support fixtures which can be pre-assembled to the display rack and pre-packed with the product before the display system is shipped to the merchant, without the product support fixture becoming dislodged during packing, transit or unpacking.

SUMMARY OF THE INVENTION

It is therefore an object of the present invention to provide a point-of-purchase product display system utilizing an outwardly-projecting product support fixture which may be pre-assembled to a foldup display stand and pre-packed with product for shipment to, and assembly by, the point-of-purchase merchant.

It is a further object of the present invention to provide a product support fixture which is adapted for pre-installation to the display stand and for pre-packing with the product prior to shipment and final assembly which is able to withstand the omni-directional forces imparted to the display fixture during packing, shipping and assembly of the display system without being pulled out of the display stand, regardless of the attitude of the partially-assembled stand.

It is yet a further object of the present invention to provide such a retail display system and a product support fixture that may be inexpensively fabricated but which is attractive to the consumer and achieves a high set-up ratio for the merchant.

These objects are preferably accomplished in a support fixture having one end cantilevered outwardly from the stand at a slight inclination to the horizontal when the stand is in an upright position for suspending the product therefrom, and a mounting end adapted to permit insertion from one side only of a display stand into a horizontal, rectangular mounting aperture contained in the stand, the mounting end having means located thereat for gripping the support stand material through the rectangular aperture and for coupling loads applied to the fixture from any direction to the support stand such that the fixture is resistant to withdrawal from the mounting aperture regardless of the attitude of the support stand, the support stand being made up of at least one sheet of thin, planar material foldable along a plurality of lines and assemblable into a rigid, three-dimensional, free-standing, upright, folded-plane structure capable of withstanding the combined weight of the product to be displayed, the stand containing at least one horizontal, rectangular aperture therein for mounting the support fixture.

These and other objects and advantages of the present invention will become evident to those skilled in the art from a consideration of the following detailed description of a preferred embodiment thereof, when read in conjunction with the appended drawings, the following of which is a brief description.

DESCRIPTION OF THE DRAWINGS

FIG. 1 is an exploded view of the support fixture and mounting-aperture-containing display stand of the present invention;

FIG. 2 is a side view of the support fixture shown installed in the rectangular mounting aperture of the display stand;

FIG. 3 is a view into the rear side of the installed support fixture, as revealed by the view III—III taken in FIG. 2;

FIG. 7 is a side view of the product support fixture of the present invention; and FIG. 8 is a cross-section through the support fixture, as revealed by the section VIII—VIII taken in FIG. 7.

DETAILED DESCRIPTION OF THE PREFERRED EMBODIMENTS

Figures 4, 5, 6:
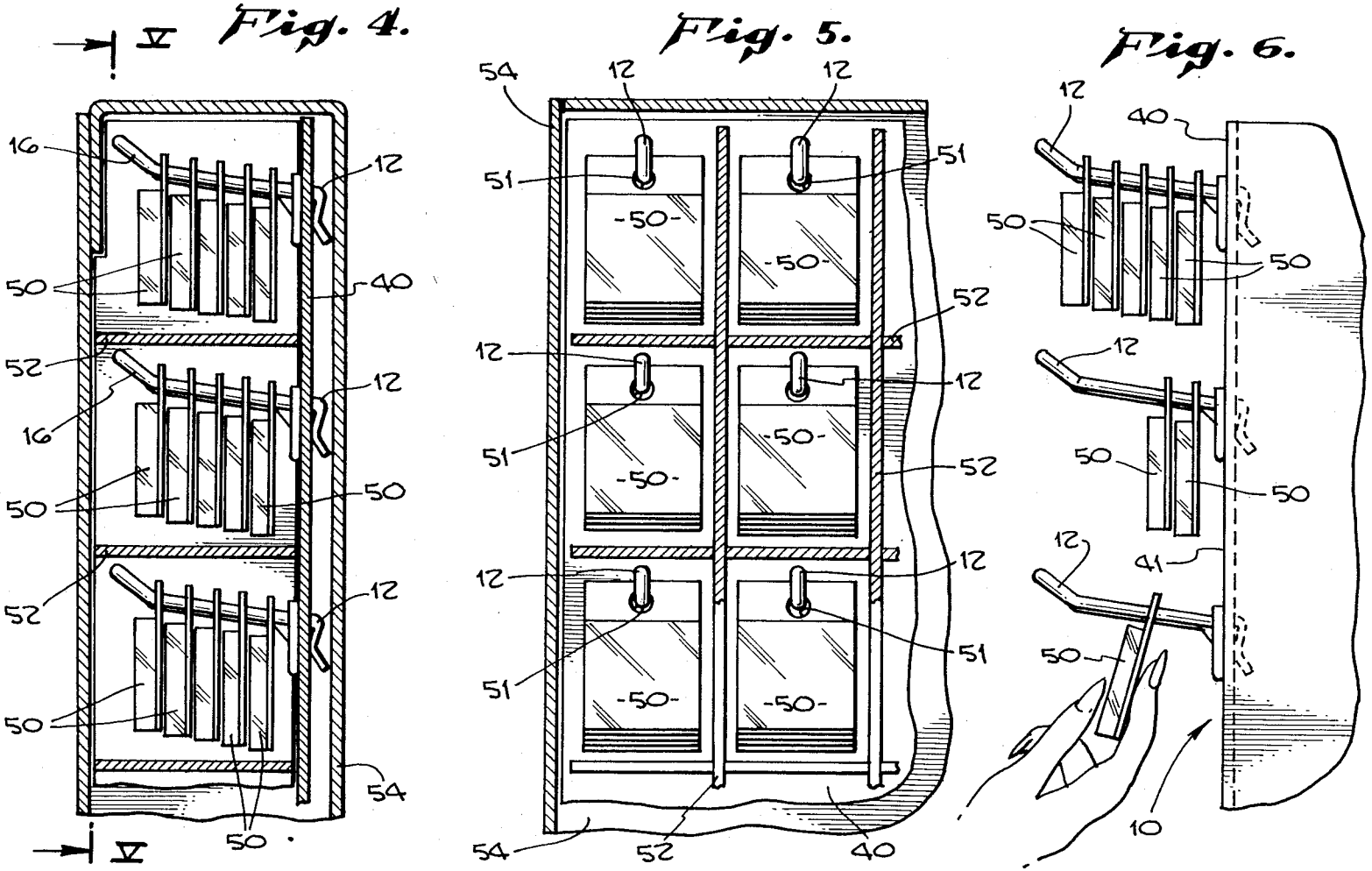
FIG. 4 is a sectional view through the side of a display system of the present invention which has been pre-packed with the product for display and packaged for shipment to the retailer.
FIG. 5 is a front, sectional view through the pre-packed display system as revealed by the section V—V taken in FIG. 4.
FIG. 6 illustrates the assembled, pre-packed display stand and fixtures of the present invention with the displayed product supported therefrom.

FIG. 1 illustrates an exploded view of an exemplary, preferred embodiment of the subject of the present invention, a product display system 10. Display system 10 includes a single-piece product display fixture 12 and a support stand 40 having a vertically-planar front face 41 containing at least one horizontal, rectangular mounting aperture 46 therethrough.

Support fixture 12 comprises an elongated, cylindrical support member 14 which is angled slightly upward from the horizontal and is terminated in an upturned portion 16 at its outer end. Support member 14 is cantilevered outwardly from the front surface of a broader face plate 18 which has a substantially planar rear surface 20 for imparting turning moments to front surface 41 of support stand 40 in a region near mounting aperture 46.

An L-shaped, substantially planar gripping finger 22 extends rearwardly from rear surface 20 of face plate 18 and has a rearward-extending, upper portion 24 having a cross-section slightly less than that of mounting aperture 46. Gripping finger 22 extends rearward for a distance slightly greater than the thickness of the material of support stand 40 and bends downwardly in an intermediate portion 26 and is then curved rearwardly at the lower end 28 thereof to permit gripping finger 22 to be inserted into rectangular aperture 46 from the front side 41 of display stand 40 without requiring any access to the lock side thereof. Additionally, gripping finger 22 is sprung inwardly toward the rear surface 20 of face plate 18 to increase the gripping force upon the stand material.

Gripping finger 22 extends rearwardly from face plate 18 at a point in line with the axis of support member 14 at a position sufficiently below the upper edge of face plate 18 that a portion 30 of face plate 18 extends above gripping finger 22 and in contact with support stand front surface 41 immediately above mounting aperture 46 which permits support fixture 12 to resist upward-acting forces exerted upon it without being dislodged from mounting aperture 46 while still permitting support fixture 12 to be installed with access to only one side of support stand 40.

In the exemplary embodiment illustrated in the figures, face plate 18 is about ¾" wide by 1" high by 0.10" thick, while support member 14 is approximately 2/10th of an inch in diameter and may be made in a variety of lengths to accomodate various sizes of product packages. Support member 14 is inclined from the horizontal at an angle of about 8°, whereas the upturned end 16 is inclined upwardly at an angle of about 30° relative to support member 14.

Skilled practitioners will recognize that support fixture 12 may be easily molded from a variety of inexpensive, lightweight plastics, e.g., nylon, and if injection molded, the dies can be configured appropriately to add additional features, such as reinforcing gusset 32 which extends from the front face plate to the underside of support member 14, as well as strengthening rib 34 (see FIG. 8), both of which add significant strength and stiffness to support fixture 12 at relatively little or no cost and addition of weight.

Display stand 40 comprises at least one sheet 42 of a thin planar material, e.g., corrugated cardboard carton stock, which has been crimped or perforated along a plurality of lines to form a plurality of panels hingably attached to one another which may be folded up to form a rigid, three-dimensional, freely standing, upright, folded-plane structure in a fashion which is known in the art. A typical display stand will include at least one vertical, folded-plane panel 40 having a vertically-planar front face 41 containing a plurality of horizontal, rectangular fixture-mounting apertures 46. It has been found that, particularly within thin sheet materials such as cardboard, corrugated cardboard, foam-core, etc., it is desirable to have a relatively large width-to-height ratio, coupled with a relatively wide face plate 18 and gripping finger 22 on support fixture 12, as this configuration tends to distribute the shear loads in the panel caused by the hanging weight of the displayed product to be distributed over a much wider area, permitting larger loads to be suspended from support fixture 12 without tearing of the panel material. Some prior art support fixtures are deficient in this regard, particularly those which embody a very narrow fixture mounting end, coupled with a vertically-oriented rectangular mounting aperture i.e., one whose longest dimension is oriented vertically, or those support fixtures having a pair of cylindrical wire gripping fingers.

In the exemplary embodiment illustrated in the figures, support stand 40 is formed from conventional corrugated cardboard stock. Since, in use, a majority of the loads acting upon support stand 40 will be applied by downward-acting product loads, the corrugations are oriented vertically to provide maximum stiffness in the vertical direction, as illustrated. However, skilled practitioners will recognize that the display system 10 illustrated also lends itself well to fabrication from other materials, such as plain cardboard, bi-directional cardboard carton stock, or even foam-core. Applicant has had good experience with display stands fabricated from these and other materials. Those skilled in the art will recognize that these materials are well adapted to be die-stamped from flat stock and imprinted with a manufacturer's advertising message by conventional color-ink or lithography techniques.

In its intended, typical use, display system 10 is supplied to the manufacturer in a flat, disassembled configuration. Display system 10 will typically comprise a plurality of support fixtures 14, and a plurality of display stand panels 40, which may include a foldup base, a vertical display panel containing a plurality of rectangular mounting apertures, and one or more "sign board" panels, i.e., attention-getting panels which are assembled to the base and/or vertical panel and direct the consumer's attention to the product being displayed.

The manufacturer will then partially assemble the display system 10 by inserting gripping finger 22 into aperture 46 until support fixture 12 snaps into place against front face 41 of display stand 40, typically when it is in a horizontal position on a packing table (see FIGS. 4, 5 and 6). A product 50 which is to be displayed is then installed on each of the support fixtures 12, typically by means of a aperture 51 contained in the product or its package through which the support member 14 of support fixture 12 is inserted to arrange the products 50 in a stacked, tandem fashion on each support fixture 12. An "egg-crate" packing material 52 is then placed over the partially-assembled display stand 40 to isolate the products from one another and to protect them during shipping, and the pre-packed, partially-assembled display system 10 is then packed within a conventional shipping container 54 for shipment to the retail merchant. Upon receipt, the merchant simply removes pre-packed display system 10 from its shipping container 54, assembles the various portions of display stand 40 and removes egg-crate packing material 52 to prepare display system 10 for presentation to the customer. No additional stocking, shelving, etc. are required.

In the upright position, support fixtures 12 are contilevered outwardly and slightly upward from the front surface 41 of display stand 40 such that the pre-packed product 50 are suspended in an aligned, stacked fashion, the outermost product being easily seen and accessed by a purchaser on a last-in-first-out basis (see FIG. 6). In the event the retail merchant or a purchaser inadvertently applies an upward-activing force to support fixture 14 during installing or removal of a display product 50, support fixture 12 will not easily be dislodged from support stand 40.

By now, skilled practitioners will recognize that the particular configurations, materials, and methods of manufacture illustrated and discussed herein are exemplary in nature and a wide variety of display systems may be obtained by various modifications thereof, depending upon the particular application at hand. Accordingly, the scope and spirit of the instant invention should be limited only by the claims appended hereto.

I claim:

1. A support fixture for use in combination with a pre-packed product display system of the type having a folded-plane support stand containing at least one horizontal, rectangular aperture therethrough for mounting said support fixture therein, comprising:

a faceplate having a substantially planar rear surface for imparting turning moments to the front surface of said support stand in a region about said aperture;

an L-shaped, substantially planar gripping finger having a cross section slightly less than that of said rectangular aperture such that said finger is substantially coextensive with said aperture to prevent movement of said finger within said aperture by forces acting on said faceplate in a direction parallel thereto, said finger being attached to said faceplate rear surface at a position sufficiently below the upper edge of said faceplate such that a portion of said faceplate rear surface extends above said gripping finger and in contact with said support stand front surface immediately above said aperture when said fixture is mounted therein for resisting moments acting upwardly on said faceplate, said gripping finger extending rearwardly from said faceplate rear surface through said aperture for a distance slightly greater than said support stand material thickness and downwardly for a length sufficient to grip said support stand material firmly between said finger and said faceplate rear surface and mount said faceplate to said support stand without additional fastening means, said gripping finger being curved rearwardly at the lower end thereof to permit insertion thereof through said aperture from the front surface of said stand without requiring access to the back side of said stand and being sprung inwardly toward said faceplate to increase the gripping force upon said stand material; and an elongated support member cantilevered outwardly from the front of said faceplate for supporting said product therefrom, said support member being angled slightly upward from the horizontal and terminated in an upturned portion at its outer end.

2. The support fixture of claim 1, further comprising:

a support gusset extending between the front of said faceplate to the underside of said support member for strengthening said support member against loads acting downwardly thereon.

3. The support fixture of claim 2, further comprising:

a reinforcing rib on the underside of said support member, extending the length of said member from said base plate to said upturned portion.

4. The support fixture of claims 1, 2 or 3, wherein said faceplate, gripping finger and support member are formed of a single piece of material.

5. The support fixture of claim 4, wherein said faceplate, gripping finger and support member are molded of a single piece of plastic material.

6. A foldup, pre-packable product display system, comprising:

a support stand made of at least one sheet of flat, thin, planar material foldable along a plurality of lines in said sheet and assembleable to form a rigid, threedimensional, freely-standing, upright, folded-plane structure capable of withstanding the combined weight of said product to be displayed, said support stand having at least one generally vertical, planar, forward-facing side, said vertical side having at least one horizontal, rectangular mounting aperture therethrough; and an elongated product support fixture having one end cantilevered outwardly from said stand at a slight inclination to the horizontal when said stand is in said upright position for suspending said product therefrom in a displayed position, said support fixture having a second, mounting end adapted for insertion into said mounting aperture from said forward-facing side of sid support stand without requiring access to the back side of said stand, said mounting end having means located thereat for gripping said support stand sheet material through said rectangular aperture and for coupling loads applied to said fixture from any direction to said support stand such that said fixture is resistant to withdrawal from said aperture regardless of the attitude of said support stand, whereby said product may be prepacked onto said partially-assembled fixture and support stand and said pre-packed stand may be packaged for transporting before said stand is assembled upright for display.

7. The product display system of claim 6, wherein said support stand sheet material further comprises cardboard.

8. The product display system of claim 7, wherein said support stand sheet material further comprises corrugated cardboard carton stock.

9. The product display sytem of claim 8, wherein said product support fixture further comprises:

a faceplate having a substantially planar rear surface for imparting turning moments to the front surface of said support stand in a region about said aperture;

an L-shaped, substantially planar gripping finger having a cross section slightly less than that of said rectangular aperture attached to said faceplate rear surface at a position sufficiently below the upper edge of said faceplate such that a portion of said faceplate rear surface extends above said gripping finger and in contact with said support stand front surface immediately above said aperture when said fixture is mounted therein for resisting moments acting upwardly on said faceplate, said gripping finger extending rearwardly from said faceplate rear surface through said aperture for a distance slightly greater than said support stand material thickness and downwardly for a length sufficient to grip said support stand material firmly between said finger and said faceplate rear surface, said gripping finger being curved rearwardly at the lower end thereof to permit insertion thereof through said aperture from the front surface of said stand without requiring access to the back side of said stand and being sprung inwardly toward said faceplate to increase the gripping force upon sand stand material; and an elongated support member cantilevered outwardly from the front of said faceplate for supporting said product therefrom, said support member being angled slightly upward from the horizontal and terminated in an upturned portion at its outer end.

10. The product display system of claim 9, further comprising:

a support gusset extending between the front of said faceplate to the underside of said support member for strengthening said support member against loads acting downwardly thereon.

11. The product display system of claim 10, further comprising:

a reinforcing rib on the underside of said support member, extending the length of said member from said base plate to said upturned portion.

12. The product display system of claims 9, 10 or 11, wherein said faceplate, gripping finger and support member are formed of a single piece of material.

13. The product display system of claim 12, wherein said faceplate, gripping finger and support member are molded from a single piece of plastic material.

* * * * *